US005957344A

United States Patent [19]

Kolton

[11] Patent Number: 5,957,344

[45] **Date of Patent: *Sep. 28, 1999**

[54] ARTICLE DISPLAY ASSEMBLY INCLUDING ARTICLE PACKAGE

[75] Inventor: Chester Kolton, Westfield, N.J.

[73] Assignee: B & G Plastics, Inc., Newark, N.J.

[ * ] Notice: This patent is subject to a terminal disclaimer.

[21] Appl. No.: 08/917,397

[22] Filed: Aug. 25, 1997

[51] Int. Cl.[6] ..... A47G 25/14; A41C 1/00

[52] U.S. Cl. ..... 223/85; 150/131

[58] Field of Search ..... 223/85, DIG. 1, 223/94, 89, 87, 88; 150/131; 206/299, 278, 478

[56] References Cited

U.S. PATENT DOCUMENTS

| | | | |
|---|---|---|---|
| 2,835,300 | 5/1958 | Silha | 150/38 |
| 5,429,284 | 7/1995 | Kolton et al. | 223/85 |
| 5,433,355 | 7/1995 | Watkins | 223/1 |
| 5,501,378 | 3/1996 | Kolton et al. | 223/87 |
| 5,620,118 | 4/1997 | Kolton et al. | 223/85 |
| 5,772,087 | 6/1998 | Kolton | 223/1 |

*Primary Examiner*—Bibhu Mohanty
*Attorney, Agent, or Firm*—Robin, Blecker & Daley

[57] ABSTRACT

A hanger has first and second support members, an article hangingly supported by the first support member and a package for the article hangingly supported by the second support member. The package defines a passage therethrough and the second support member is resident in the package passage.

13 Claims, 5 Drawing Sheets

ARTICLE DISPLAY ASSEMBLY INCLUDING ARTICLE PACKAGE

FIELD OF THE INVENTION

This invention relates generally to the hanging of an article along with packaging for the article. More particularly, the invention pertains to an assembly of a wallet with a hanger wherein the wallet may be inspected without need for removal from the hanger and is jointly hung with a wallet package.

BACKGROUND OF THE INVENTION

By way of introduction to the subject invention, reference is made to commonly-assigned Pat. No. 5,429,284. This patent discloses a garment hanger comprised of a one-piece body having a hook portion for the receipt of a display rod, a central portion depending from the hook portion and having first and second openings therein, and a lower portion defining a fold line segment depending from the central portion with a third opening disposed in the fold line segment and a flap segment depending from the fold line segment. The central portion and the flap segment define coactive structure for retaining the flap segment against the central portion on folding of the flap segment about the fold line segment. The coactive structure is preferably comprised of first and second projections on the flap segment adjacent respective lateral margins thereof and first and second latching openings in the central portion adjacent respective lateral margins thereof.

In use of the hanger, with the flap segment unfolded, a garment, such as a tie, is looped through the first and second openings and then passed through the third opening. The flap is now folded against the garment and latched to the central portion.

By way of further introduction to the subject invention, reference is made to commonly-assigned U.S. Pat. No. 5,501,378, which discloses a garment hanger comprised of a one-piece body having a hook portion for the receipt of a display rod, a central portion depending from the hook portion, the body defining in the central portion an opening therethrough and a garment support member disposed in the opening and movable relative to the body and a lower portion defining a fold line segment depending from the central portion and a flap segment depending from the fold line segment, the central portion, the fold line segment and the flap segment jointly defining a slot in the body which opens into a margin of the body.

The central portion and the flap segment define coactive means for retaining the flap segment against the central portion on folding of the flap segment about the fold line segment.

The fold line segment is disposed contiguously with an interior end of the slot and provides cantilever support for the flap segment.

Further background to the subject invention is found in U.S. Pat. Nos. 5,421,494 and 5,452,828, both of which disclose hanger assemblies wherein structure defining a compartment for a promotional article is hung jointly with the article to be sold.

In the '494 patent, there is provided a hanger composite including a first hanger having a hook portion for releasable securement to a display rod and an elongate foldable tail portion, the tail portion defining a latching opening therethrough and a projection extending outwardly of the tail portion to a given extent for latching disposition in the latching opening, and a second hanger assembled with the first hanger and defining a compartment for containment of an article, the second hanger having an opening therethrough configured complementally with the tail portion of the first hanger and enabling the assembly of the first and second hangers.

In the '828 patent, there is provided a display assembly including a belt having a buckle, a belt blank secured with the buckle and a retaining member secured with the belt blank adjacent the buckle for retaining a portion of the belt blank issuing from the buckle upon belt buckling and a hanger having a hook portion disposed on the belt retaining member, the hook portion defining locking structure for capturing the belt retaining member in the hook portion, and a compartment portion depending from the hook portion, the compartment being adapted for containment of an article to be marketed with the belt.

SUMMARY OF THE INVENTION

The present invention has as its primary object the provision of an assembly of an article with a hanger, wherein the article may be inspected without need for removal from the hanger, and packaging for the article jointly hung therewith.

The present invention has as a more particular object the provision of an assembly of a wallet with a hanger, wherein the wallet may be inspected without need for removal from the hanger, and packaging for the wallet jointly hung therewith.

In attaining such primary object, the invention provides, in combination, a hanger having first and second support members, an article hangingly supported by the first support member and a package for the article hangingly supported by the second support member. The package defines a passage therethrough and the second support member is resident in the package passage.

In attaining the more particular object, the invention provides, in combination, a hanger comprised of a one-piece body having a hook portion for the receipt of a display rod, a central portion depending from the hook portion, the body defining in the central portion a transverse opening therethrough fully bounded by the central portion, a fold line portion depending from the central portion and a flap segment contiguous with the fold line portion and secured to the central portion, a wallet having a first part disposed in the transverse opening and at least second and third parts extending outwardly of the one-piece body, a portion of the wallet second part being disposed between the central portion and the flap segment, the wallet third part being disposed fully outwardly of the hanger and a package for the article hangingly supported by the flap segment. The package defines a passage therethrough and the flap segment is resident in the package passage.

The foregoing and other objects and features of the invention will be further evident from the following detailed description of a preferred embodiment thereof and from the drawings in which like components are identified by like reference numerals throughout.

DETAILED DESCRIPTION OF THE PREFERRED EMBODIMENT

Figure 2:
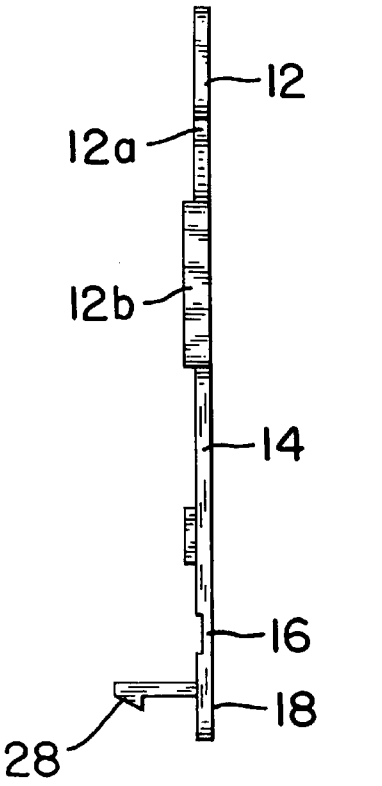
FIG. 2 is a right side elevational view of the FIG. 1 hanger.
Figure 1:
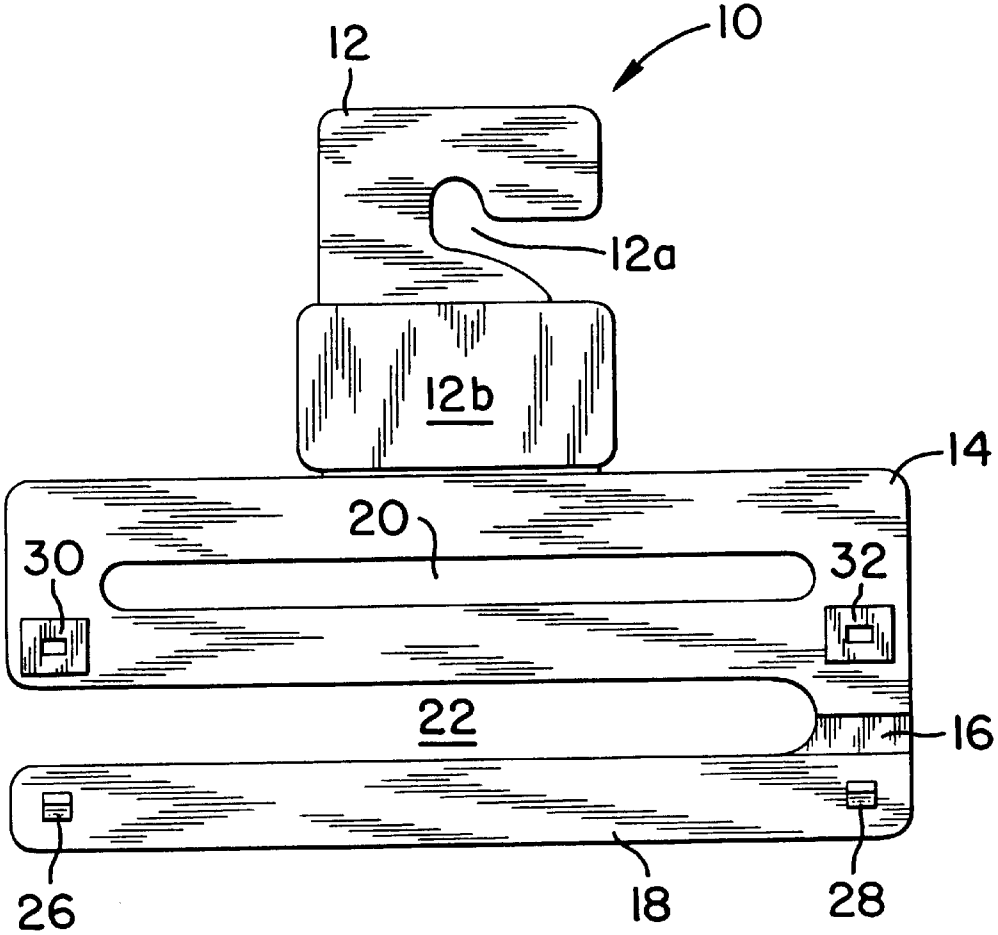
FIG. 1 is a rear elevational view of a hanger in accordance with the invention prior to its assembly with a wallet to be hung for display.

Referring to FIGS. 1 and 2, hanger 10 in accordance with the invention is comprised of a one-piece body having a hook portion 12 with a channel 12*a* for the receipt of a display rod and with a logo display area 12*b*, a central portion 14 depending from the hook portion, a fold portion 16 depending from the central portion and a flap segment 18 depending from fold portion 16 and cantilever-supported thereby. Fold portion 16 is constituted by thinning out the one-piece body to have a lesser thickness than the thickness of central portion 14 and flap segment 18, as is shown in FIG. 2.

The body defines in central portion 14 a transverse opening 20 therethrough, fully bounded by central portion 14. Central portion 14, fold line portion 16 and flap segment 18 collectively define slot 22 in the body which opens into a margin of the body.

Central portion 14 and flap segment 18 define coactive means for securing the flap segment against the central portion. The coactive means is preferably comprised of first and second projections 26 and 28 on flap segment 18 adjacent respective lateral margins thereof and first and second latching openings 30 and 32 in the central portion adjacent respective lateral margins thereof.

While the hanger may be constructed such that the coactive means is releasable, it is preferred that the retention not be releasable and that cutting is required to remove a wallet from the hanger.

Figure 3:
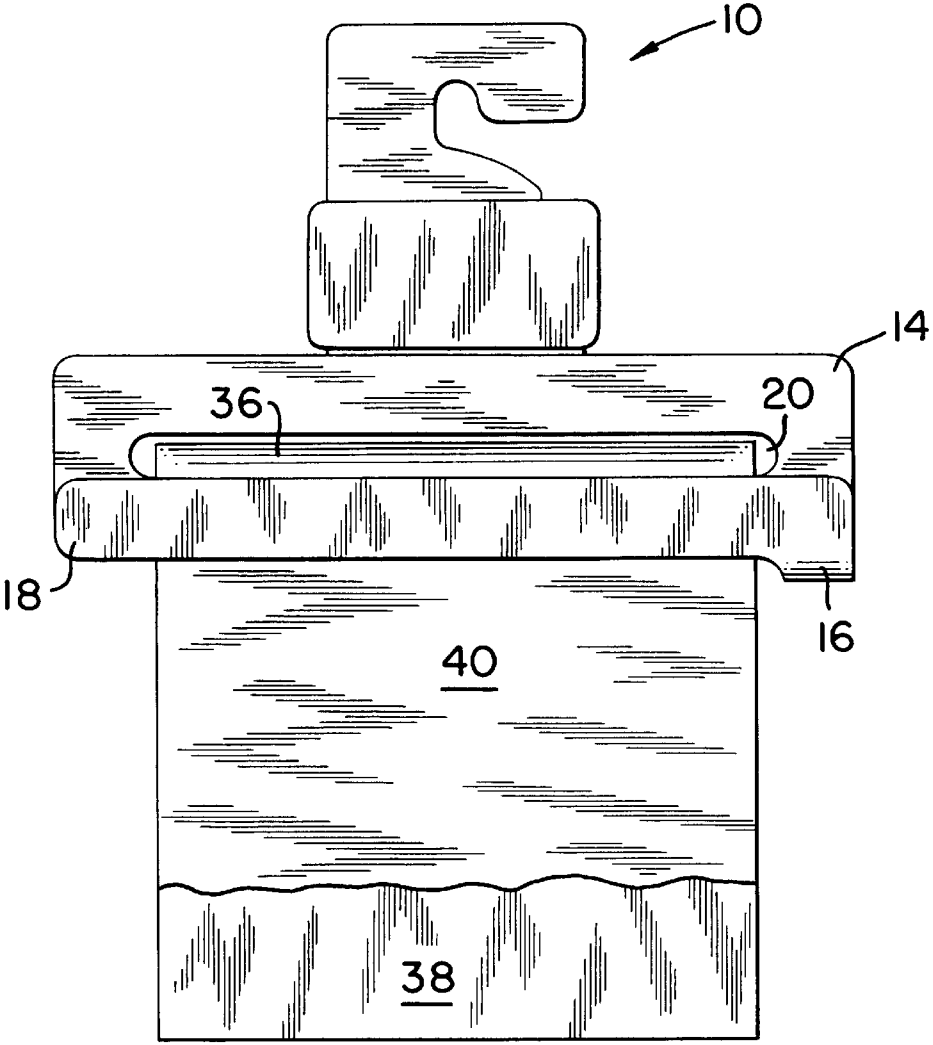
FIG. 3 is a rear elevational view of the hanger of FIGS. 1 and 2 assembled with a wallet.

In FIG. 3, hanger 10 is shown in assembly with wallet 34 with the wallet partly broken away. In reaching the assembly of FIG. 3, wallet part 38 is inserted, free end first, into opening 20 of hanger 10 until fold part 36 is resident in opening 20. At this juncture, wallet part 40 is placed in slot 22, the placement being facilitated by the cantilever-support of flap segment 18 by fold portion 16. Wallet part 38 is disposed fully exteriorly of hanger 10. Flap segment 18 is now folded about fold portion 16, i.e., onto wallet part 40, wallet fold part 36 being ensnared between flap segment 18 and hanger central portion 14 upon engagement of projections 26 and 28 and latching openings 30 and 32.

Figure 4:
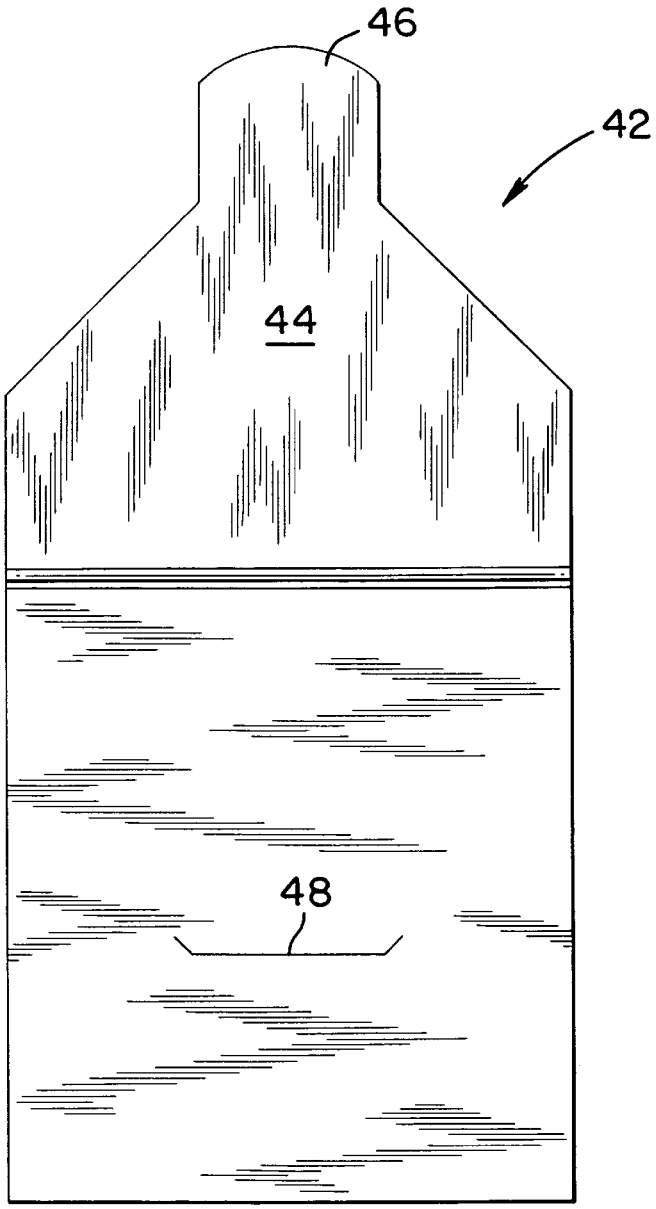
FIG. 4 is front elevational view of a package adapted for containment of the wallet of FIG. 3 and for hanging therewith by the hanger of FIGS. 1–3.
Figure 5:
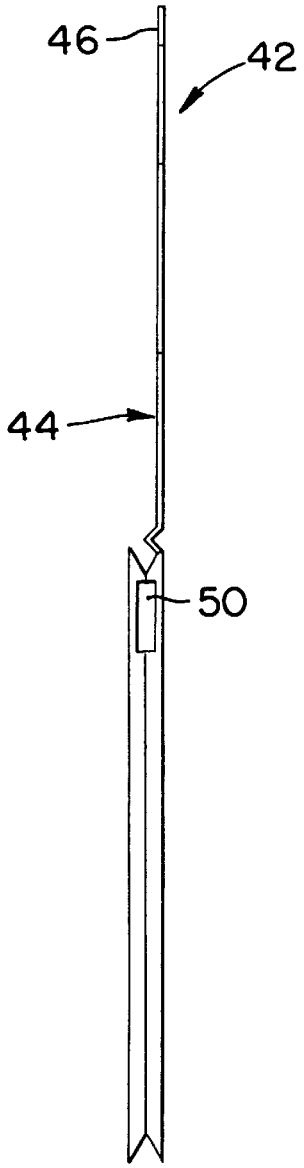
FIG. 5 is a right side elevational view of the FIG. 4 package.
Figure 7:
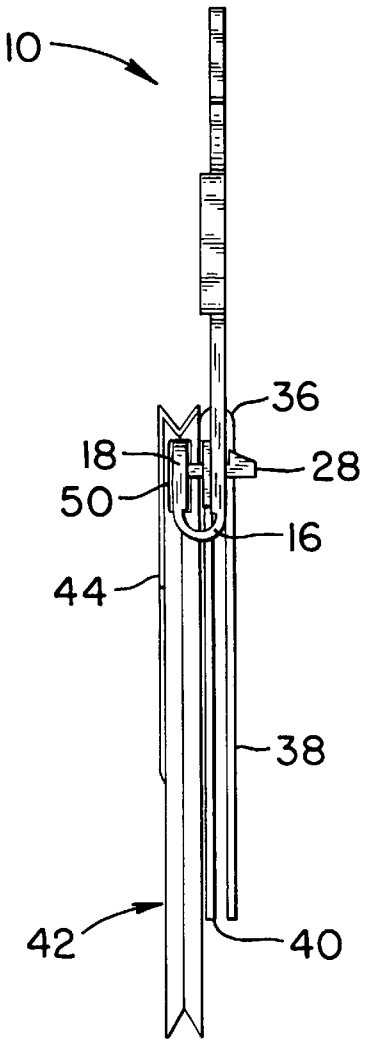
FIG. 7 is a right side elevational view of the FIG. 6 assembly.
Figure 6:
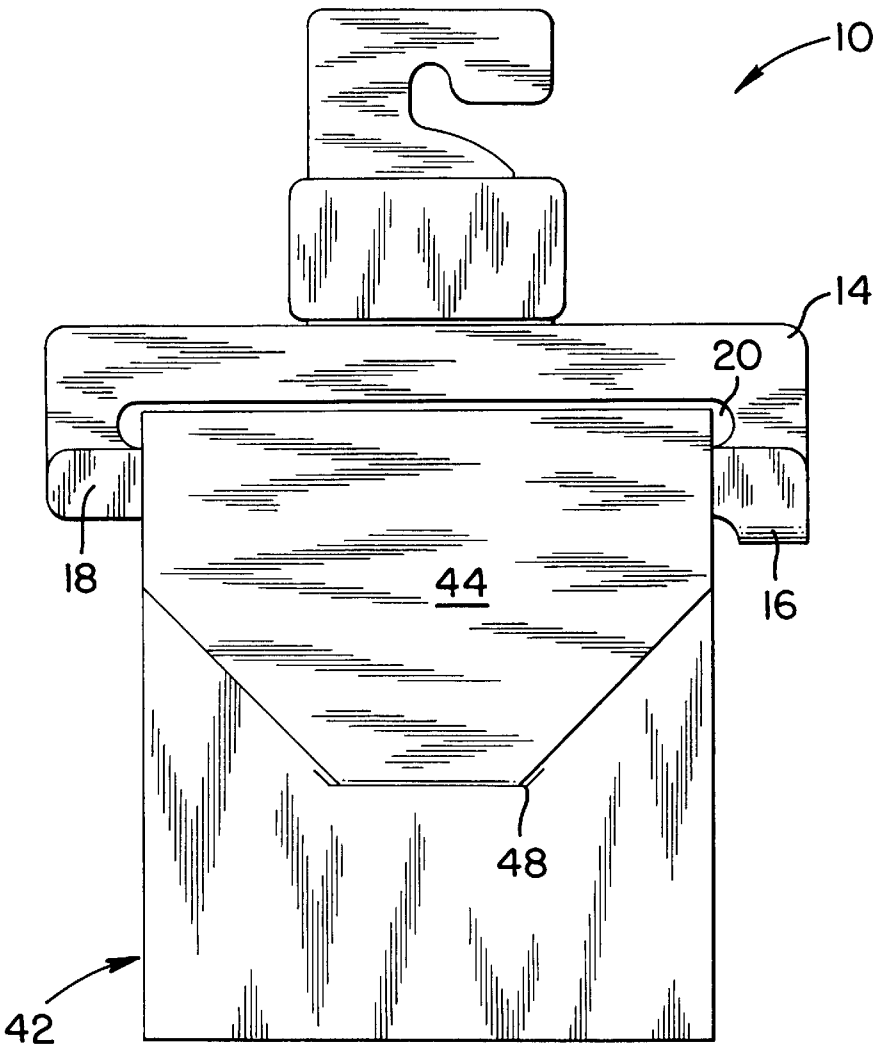
FIG. 6 is a rear elevational view of the hanger of FIGS. 1 and 2 assembled with both the wallet of FIG. 3 and the package of FIGS. 4 and 5.

Referring to FIGS. 4 and 5, package 42 may be constructed of thin sheet material and defines an interior compartment configured to contain wallet 34, a closure flap 44 having insert end 46, and a slot 48 for receipt of insert end 46 on folding of closure flap 44.

Openings, one being shown at 50 in FIG. 5 (the other not shown), are formed in the sidewalls of package 42 and extend into the interior compartment, thus defining a passage extending transversely through the package. Opening 50 (and the opening not shown) are configured complementally with flap segment 18, whereby the flap segment may be inserted through opening 50, to exit through the opening not shown, and thus to be assembled with package 42. Upon such assembly, flap segment is folded onto central portion 14 (wallet 34 being preassembled with the hanger as above described), and the assembly of hanger, wallet and wallet package is complete.

While shown as of rectangular configuration in FIG. 5, opening 50 is desirably of circular configuration to facilitate rotation of package 42 about flap segment prior to folding of the flap segment to properly orient package 42 relative to the hung wallet.

As will be appreciated, upon rotation of the FIG. 5 assembly by one-hundred and eighty degrees about a vertical axis, hook portion 12 is insertable onto a display rod from the right hand side of the rod and wallet part 38 is fully viewable to a shopper and may be lifted for shopper inspection of the wallet without need for disassembly of the wallet, package and hanger. Upon lifting of wallet part 38, wallet part 40 is likewise fully viewable.

When a purchaser elects to purchase a so displayed wallet, the checkout clerk cuts the exposed projections 26 and 28 (FIG. 1) freeing flap segment 18 from its securement with central portion 14, removes the wallet through transverse opening 20, removes package 42 from flap segment 18 and inserts the wallet into the package, thus providing the purchaser with a packaged wallet. The exterior of package 42 is desirably provided with a wrapping paper like design.

Figure 8:
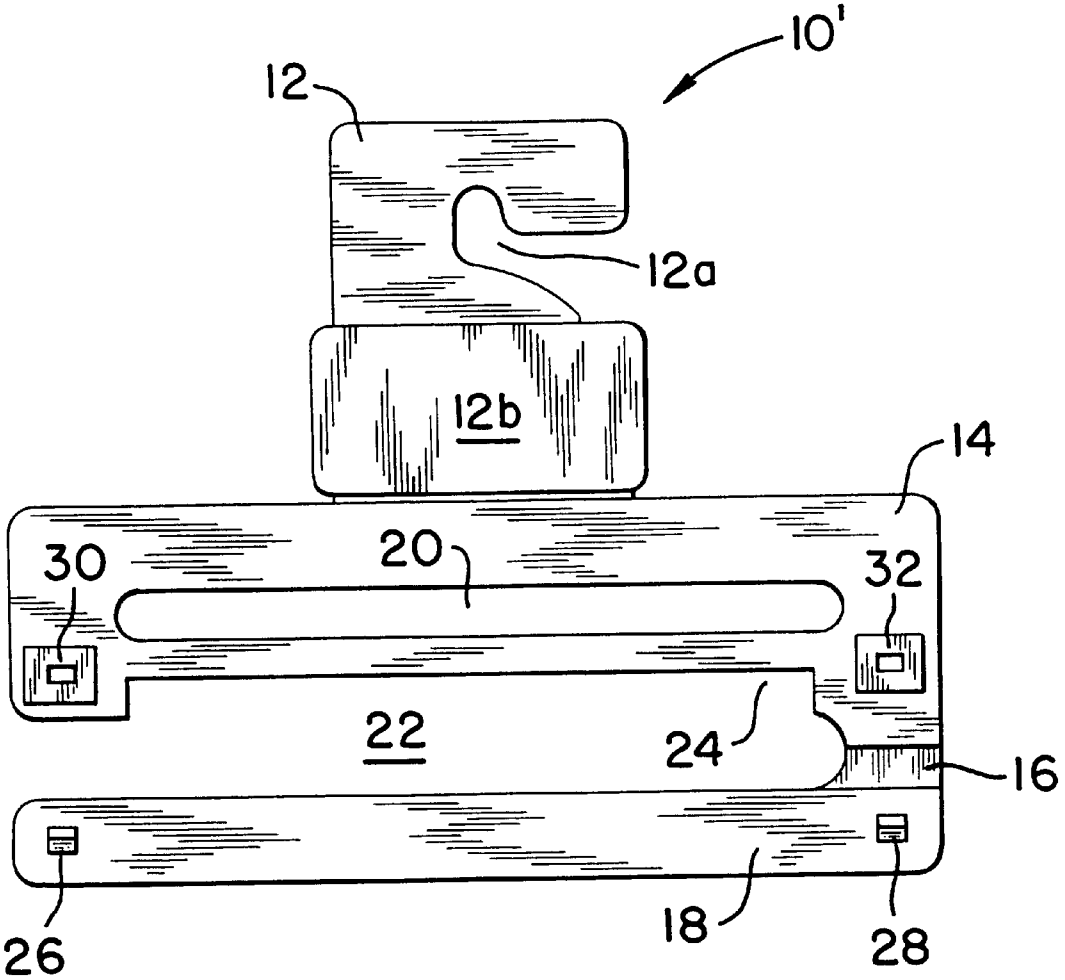
FIG. 8 is a rear elevational view of a further hanger in accordance with the invention prior to its assembly with a wallet to be hung for display and a package therefor.

Referring to FIG. 8, hanger 10' is configured in all respects as is hanger 10 with the exception that central portion 14 has a notch 24 formed therein bounding slot 22 and transversely coextensive with transverse opening 20. Such arrangement accommodates larger, more bulky wallets than hanger 10.

Various changes to the particularly disclosed embodiment and practices may evidently be introduced without departing from the invention. By way of example, the illustrated latching structure is used for applications in which high security is desired and may be replaced with other latching structure in other applications. Also, while the invention has been particularly described in the display and packaging of wallets, the invention of course lends itself generally to article and package display. Accordingly, it is to be appreciated that the particularly discussed and depicted preferred embodiment and practices of the invention are intended in an illustrative and not in a limiting sense. The true spirit and scope of the invention are set forth in the ensuing claims.

What is claimed is:

1. In combination:

a) a hanger having first and second support members;

b) an article hangingly supported by said first support member; and c) a package adapted for containment of said article hangingly supported by said second support member, said package not containing said article when said article and said package are hung by said hanger, said first support member and said second support member defining coactive means for retaining said second support member against said first support member.

2. The invention claimed in claim 1, wherein said hanger has a central portion defining said first support member and a slot adjacent said first support member for receipt of said article.

3. The invention claimed in claim 1, wherein said hanger has a central portion and wherein said second support member is cantilever-supported by said central portion.

4. The invention claimed in claim 2, wherein said second support member is cantilever-supported by said central portion.

5. The invention hanger claimed in claim 1, wherein said coactive means is comprised of at least one projection on said second support member and at least one latching opening in said central portion.

6. The invention claimed in claim 1, wherein said coactive means is comprised of first and second projections on said second support member adjacent respective lateral margins thereof and first and second latching openings in said central portion adjacent respective lateral margins thereof.

7. The invention claimed in claim 1, wherein said package defines a passage therethrough, said second support member being resident in said package passage.

8. In combination, a hanger comprised of a one-piece body having a hook portion for the receipt of a display rod, a central portion depending from the hook portion, the body defining in the central portion a transverse opening therethrough fully bounded by the central portion, a fold line portion depending from the central portion and a flap segment contiguous with the fold line portion and secured to the central portion, a wallet having a first part disposed in the transverse opening and at least second and third parts extending outwardly of the one-piece body, a portion of the wallet second part being disposed between the central portion and the flap segment, the wallet third part being disposed fully outwardly of the hanger and a package adapted for containment of the wallet hangingly supported by the flap segment, said package not containing said wallet when said wallet and said package are hung by said hanger.

9. The invention claimed in claim 8, wherein said central portion and said flap segment define coactive means for retaining said flap segment against said central portion on folding of said flap segment about said fold line portion.

10. The invention claimed in claim 9, wherein said fold line portion is contiguous with an interior end of said slot and provides cantilever support for said flap segment.

11. The invention hanger claimed in claim 9, wherein said coactive means is comprised of at least one projection on said flap segment and at least one latching opening in said central portion.

12. The invention claimed in claim 9, wherein said coactive means is comprised of first and second projections on said flap segment adjacent respective lateral margins thereof and first and second latching openings in said central portion adjacent respective lateral margins thereof.

13. The invention claimed in claim 8, wherein said package defines a passage therethrough, said flap segment being resident in said package passage.

* * * * *